US011846286B2

(12) United States Patent
Nakatani et al.

(10) Patent No.: US 11,846,286 B2
(45) Date of Patent: Dec. 19, 2023

(54) SCROLL COMPRESSOR

(71) Applicant: DAIKIN INDUSTRIES, LTD., Osaka (JP)

(72) Inventors: Eitarou Nakatani, Osaka (JP); Yasuo Mizushima, Osaka (JP); Katsumi Kato, Osaka (JP); Takeshi Endou, Osaka (JP); Akira Himeda, Osaka (JP); Yukiko Maejima, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 36 days.

(21) Appl. No.: 17/744,410

(22) Filed: May 13, 2022

(65) Prior Publication Data

US 2022/0275802 A1 Sep. 1, 2022

Related U.S. Application Data

(63) Continuation of application No. PCT/JP2020/043261, filed on Nov. 19, 2020.

(30) Foreign Application Priority Data

Nov. 21, 2019 (JP) ..... 2019-210734

(51) Int. Cl.
*F04C 15/00* (2006.01)
*F04C 2/02* (2006.01)
*F04C 18/02* (2006.01)

(52) U.S. Cl.
CPC ..... *F04C 15/0088* (2013.01); *F04C 2/025* (2013.01)

(58) Field of Classification Search
CPC .... F04C 15/0088; F04C 2/025; F04C 29/028; F04C 18/02; F04C 18/0253; F04C 18/0215
See application file for complete search history.

(56) References Cited

U.S. PATENT DOCUMENTS

2018/0051697 A1* 2/2018 Murakami ..... F04C 29/028

FOREIGN PATENT DOCUMENTS

JP 2014-70598 A 4/2014
JP 5691352 B2 * 4/2015 ..... F04C 18/02
(Continued)

OTHER PUBLICATIONS

English translation of JP5691352 by PE2E Aug. 11, 2023.*
(Continued)

*Primary Examiner* — Deming Wan
(74) *Attorney, Agent, or Firm* — Global IP Counselors, LLP

(57) ABSTRACT

A scroll compressor includes fixed and movable scrolls including fixed and movable side end plates and fixed and movable side wraps. The fixed-side end plate includes a first fixed-side passage that communicates with a high-pressure space, and a second fixed-side passage to supply lubricating oil from the high-pressure space to a compression chamber formed between the scrolls. The movable-side end plate includes a movable-side groove that intermittently allows communication between the first fixed-side passage and the second fixed-side passage. The compression chamber includes a first compression chamber, and a second compression chamber located inside the first compression chamber. The second fixed-side passage includes a first fixed-side hole that intermittently communicates with the movable-side groove, and a second fixed-side hole that communicates with the first fixed-side hole and intermittently communicates with the second compression chamber.

17 Claims, 11 Drawing Sheets

(56) References Cited

FOREIGN PATENT DOCUMENTS

| | | | | |
|---|---|---|---|---|
| JP | 2016-160816 | A | 9/2016 | |
| WO | WO-2012127795 | A1 * | 9/2012 | ..... F04C 15/0088 |

OTHER PUBLICATIONS

English translation of WO2012127795 by PE2E Aug. 11, 2023.*
International Search Report of corresponding PCT Application No. PCT/JP2020/043261 dated Dec. 28, 2020.
European Search Report of corresponding EP Application No. 20 89 0403.7 dated Nov. 25, 2022.
International Preliminary Report of corresponding PCT Application No. PCT/JP2020/043261 dated Jun. 2, 2022.

* cited by examiner

SCROLL COMPRESSOR

CROSS-REFERENCE TO RELATED APPLICATIONS

This is a continuation of International Application No. PCT/JP2020/043261 filed on Nov. 19, 2020, which claims priority to Japanese Patent Application No. 2019-210734, filed on Nov. 21, 2019. The entire disclosures of these applications are incorporated by reference herein.

BACKGROUND

Technical Field

A scroll compressor used in an air conditioner and the like.

Background Art

JP 2014-070598 A discloses a scroll compressor including a passage for supply of lubricating oil from a high-pressure space in a casing to a compression chamber.

SUMMARY

A scroll compressor according to a first aspect includes a fixed scroll including a fixed-side end plate and a fixed-side wrap, and a movable scroll including a movable-side end plate and a movable-side wrap. The fixed-side end plate includes a first fixed-side passage that communicates with a high-pressure space, and a second fixed-side passage configured to supply lubricating oil from the high-pressure space to a compression chamber formed between the fixed scroll and the movable scroll. The movable-side end plate includes a movable-side groove that intermittently allows communication between the first fixed-side passage and the second fixed-side passage while the movable scroll revolves relative to the fixed scroll. The compression chamber includes a first compression chamber located on an outermost side, and a second compression chamber located inside the first compression chamber and located between an outermost side surface of the fixed-side wrap and an inner side surface of the movable-side wrap. The second fixed-side passage includes a first fixed-side hole that intermittently communicates with the movable-side groove while the movable scroll revolves relative to the fixed scroll, and a second fixed-side hole that communicates with the first fixed-side hole and intermittently communicates with the second compression chamber while the movable scroll revolves relative to the fixed scroll.

DETAILED DESCRIPTION OF EMBODIMENT(S)

(1) Overall Configuration

A scroll compressor 101 is used in a device including a vapor compression refrigeration cycle using a refrigerant. Examples of the device using the scroll compressor 101 include an air conditioner and a refrigeration apparatus. The scroll compressor 101 compresses a refrigerant circulating in a refrigerant circuit constituting the refrigeration cycle.

Figure 1:
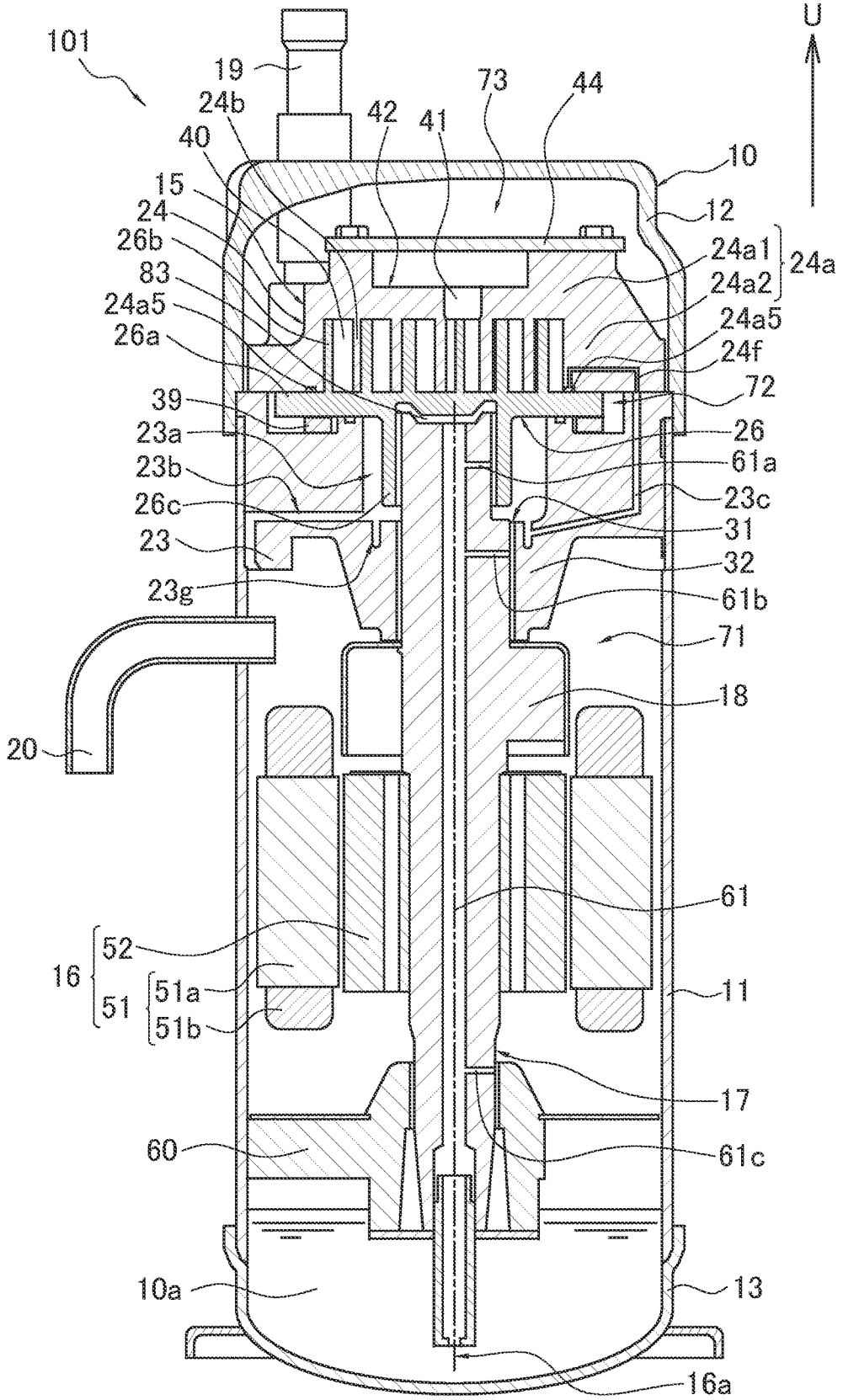
FIG. 1 is a longitudinal cross-sectional view of a scroll compressor 101.

FIG. 1 is a longitudinal cross-sectional view of the scroll compressor 101. In FIG. 1, an arrow U indicates an upper side in a vertical direction. The scroll compressor 101 mainly includes a casing 10, a compression mechanism 15, a housing 23, an Oldham's coupling 39, a motor 16, a lower bearing 60, a crankshaft 17, a suction pipe 19, and a discharge pipe 20.

(1-1) Casing 10

The casing 10 includes a body casing part 11 having a cylindrical shape, an upper wall part 12 having a bowl shape, and a bottom wall part 13 having a bowl shape. The upper wall part 12 is airtightly welded to an upper end part of the body casing part 11. The bottom wall part 13 is airtightly welded to a lower end part of the body casing part 11.

Inside the casing 10, the compression mechanism 15, the housing 23, the Oldham's coupling 39, the motor 16, the lower bearing 60, and the crankshaft 17 are mainly accommodated. The suction pipe 19 and the discharge pipe 20 are airtightly welded to the casing 10.

At a bottom part of an internal space of the casing 10, an oil reservoir 10*a*, which is a space where lubricating oil is stored, is formed. The lubricating oil is refrigerator oil used to keep favorable lubricity of the compression mechanism 15, the crankshaft 17, and the like during operation of the scroll compressor 101.

(1-2) Compression Mechanism 15

Figure 2:
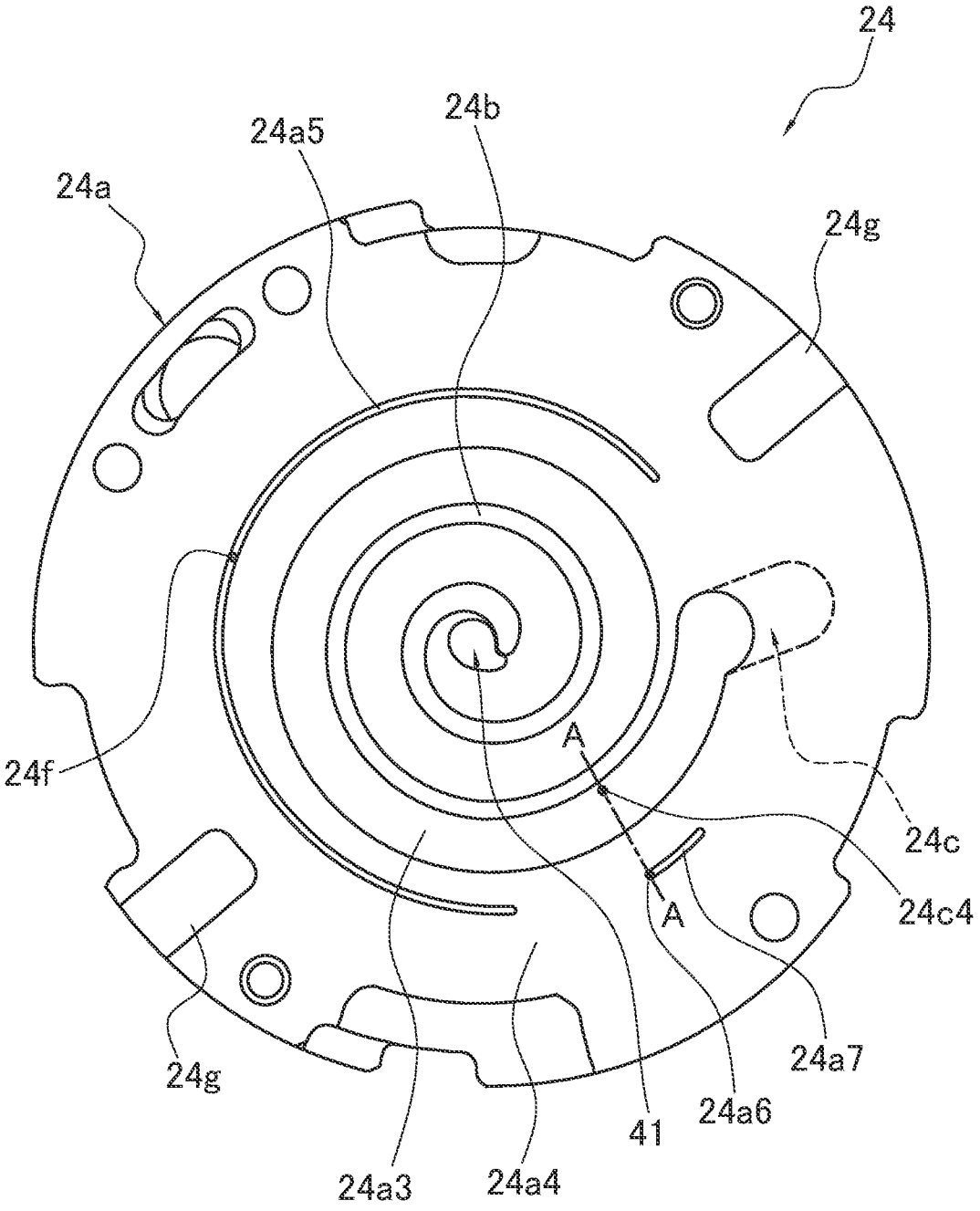
FIG. 2 is a bottom view of a fixed scroll 24.
Figure 3:
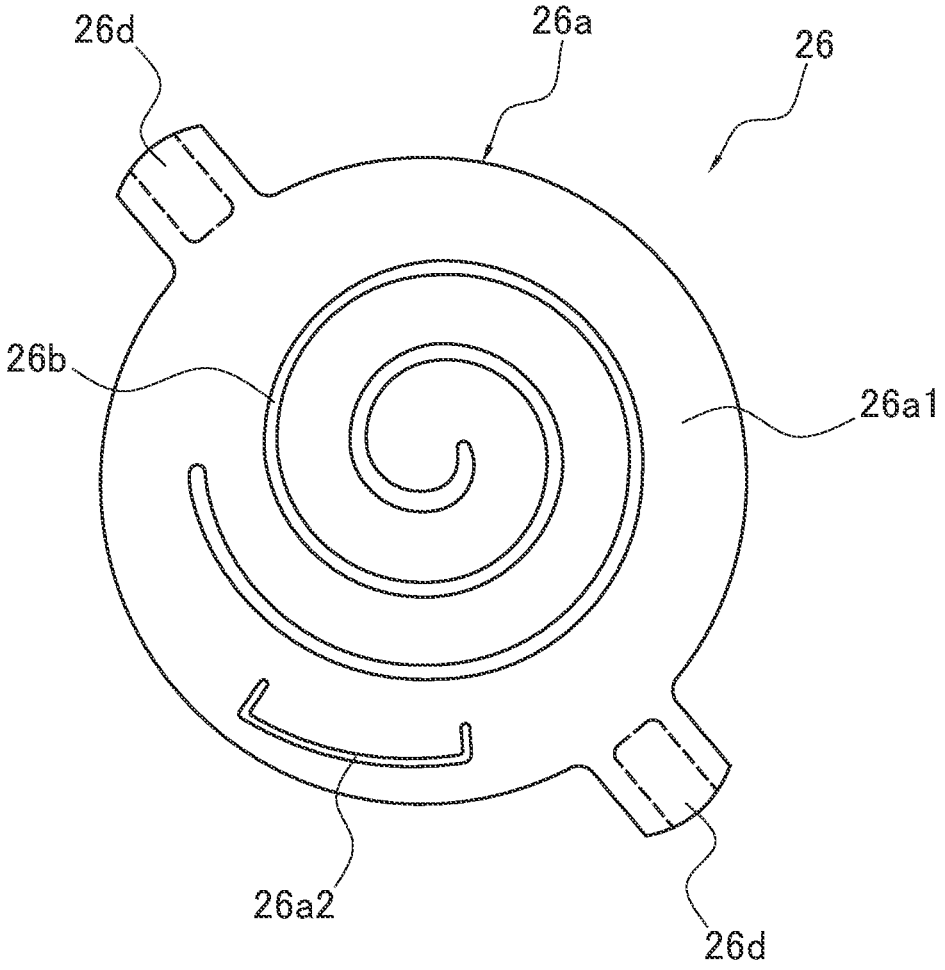
FIG. 3 is a top view of a movable scroll 26.

The compression mechanism 15 suctions and compresses low-temperature and low-pressure refrigerant gas, and discharges high-temperature and high-pressure refrigerant gas (hereinafter, referred to as a "compressed refrigerant"). The compression mechanism 15 mainly includes a fixed scroll 24 and a movable scroll 26. The fixed scroll 24 is fixed to the casing 10. The movable scroll 26 makes turning motion of turning relative to the fixed scroll 24. FIG. 2 is a bottom view of the fixed scroll 24 as viewed along the vertical direction. FIG. 3 is a top view of the movable scroll 26 as viewed along the vertical direction.

(1-2-1) Fixed Scroll 24

The fixed scroll 24 includes a fixed-side end plate 24*a* and a fixed-side wrap 24*b*. The fixed-side end plate 24*a* includes a disk-shaped main body 24*a*1 and a peripheral edge 24*a*2 surrounding the fixed-side wrap 24*b*. The fixed-side wrap 24*b* protrudes from a first lower surface 24*a*3 of the main body 24*a*1 of the fixed-side end plate 24*a*. The fixed-side wrap 24*b* has a spiral shape when viewed along the vertical direction. As illustrated in FIG. 2, a first fixed-side passage 24*a*5 and a fixed-side groove 24*a*7 are formed on a second lower surface 24*a*4 of the peripheral edge 24*a*2 of the fixed-side end plate 24*a*. Inside the fixed-side end plate 24*a*, a second fixed-side passage 24*a*6 is formed.

In the fixed-side end plate 24*a*, a main suction hole 24*c* is formed. The main suction hole 24*c* is a space connecting the suction pipe 19 and a compression chamber 40 to be described later. The main suction hole 24*c* is a space for introducing low-temperature and low-pressure refrigerant gas from the suction pipe 19 into the compression chamber 40.

As illustrated in FIG. 2, the first fixed-side passage 24*a*5 is a groove having a C shape. Inside the fixed-side end plate 24*a* outside the fixed-side wrap 24*b*, an oil communication passage 24*f* is formed. One end of the oil communication passage 24*f* opens to the second lower surface 24*a*4, and another end of the oil communication passage 24*f* communicates with the first fixed-side passage 24*a*5. Details of the first fixed-side passage 24*a*5, the second fixed-side passage 24*a*6, and the fixed-side groove 24*a*7 will be described later.

As illustrated in FIG. 1, an enlarged concave portion 42, which is a columnar concave portion, is formed on an upper surface of the fixed-side end plate 24*a*. The enlarged concave portion 42 is covered with a cover member 44. On a bottom surface of the enlarged concave portion 42, a discharge hole 41 is formed. The discharge hole 41 communicates with the compression chamber 40.

In the fixed-side end plate 24*a*, a first compressed refrigerant flow path (not illustrated) is formed. The first compressed refrigerant flow path communicates with the enlarged concave portion 42, and is open to the second lower surface 24*a*4 of the fixed-side end plate 24*a*. Through this opening, the first compressed refrigerant flow path communicates with a second compressed refrigerant flow path described later.

On the second lower surface 24*a*4 of the fixed-side end plate 24*a*, two first key grooves 24*g* are formed. Into each of the first key grooves 24*g*, a first key part 39*b* of the Oldham's coupling 39 described later is fitted.

(1-2-2) Movable Scroll 26

The movable scroll 26 includes a movable-side end plate 26*a*, a movable-side wrap 26*b*, and an upper end bearing 26*c*. The movable-side wrap 26*b* protrudes from a first upper surface 26*a*1 of the disk-shaped movable-side end plate 26*a*. The movable-side wrap 26*b* has a spiral shape when viewed along the vertical direction. The upper end hearing 26*c* protrudes from a central portion of a lower surface of the movable-side end plate 26*a*. The upper end hearing 26*c* has a cylindrical shape. The movable-side end plate 26*a* has a movable-side groove 26*a*2. As illustrated in FIG. 3, the movable-side groove 26*a*2 is formed on the first upper surface 26*a*1. Details of the movable-side groove 26*a*2 will be described later.

The fixed scroll 24 and the movable scroll 26 form the compression chamber 40 by the second lower surface 24*a*4 of the fixed-side end plate 24*a* and the first upper surface 26*a*1 of the movable-side end plate 26*a* being in contact with each other, and the fixed-side wrap 24*b* and the movable-side wrap 26*b* being combined so as to mesh with each other. The compression chamber 40 is a space surrounded by the fixed-side end plate 24*a*, the fixed-side wrap 24*b*, the movable-side end plate 26*a*, and the movable-side wrap 26*b*. A volume of the compression chamber 40 is periodically changed by turning motion of the movable scroll 26. While the movable scroll 26 is turning, surfaces of the fixed-side end plate 24*a* and the fixed-side wrap 24*b* of the fixed scroll 24 slide on surfaces of the movable-side end plate 26*a* and the movable-side wrap 26*b* of the movable scroll 26. Hereinafter, the surface of the fixed-side end plate 24*a* that slides with the movable scroll 26 is referred to as a thrust sliding surface 24*d*. The thrust sliding surface 24*d* is a part of the second lower surface 24*a*4.

Figure 4:
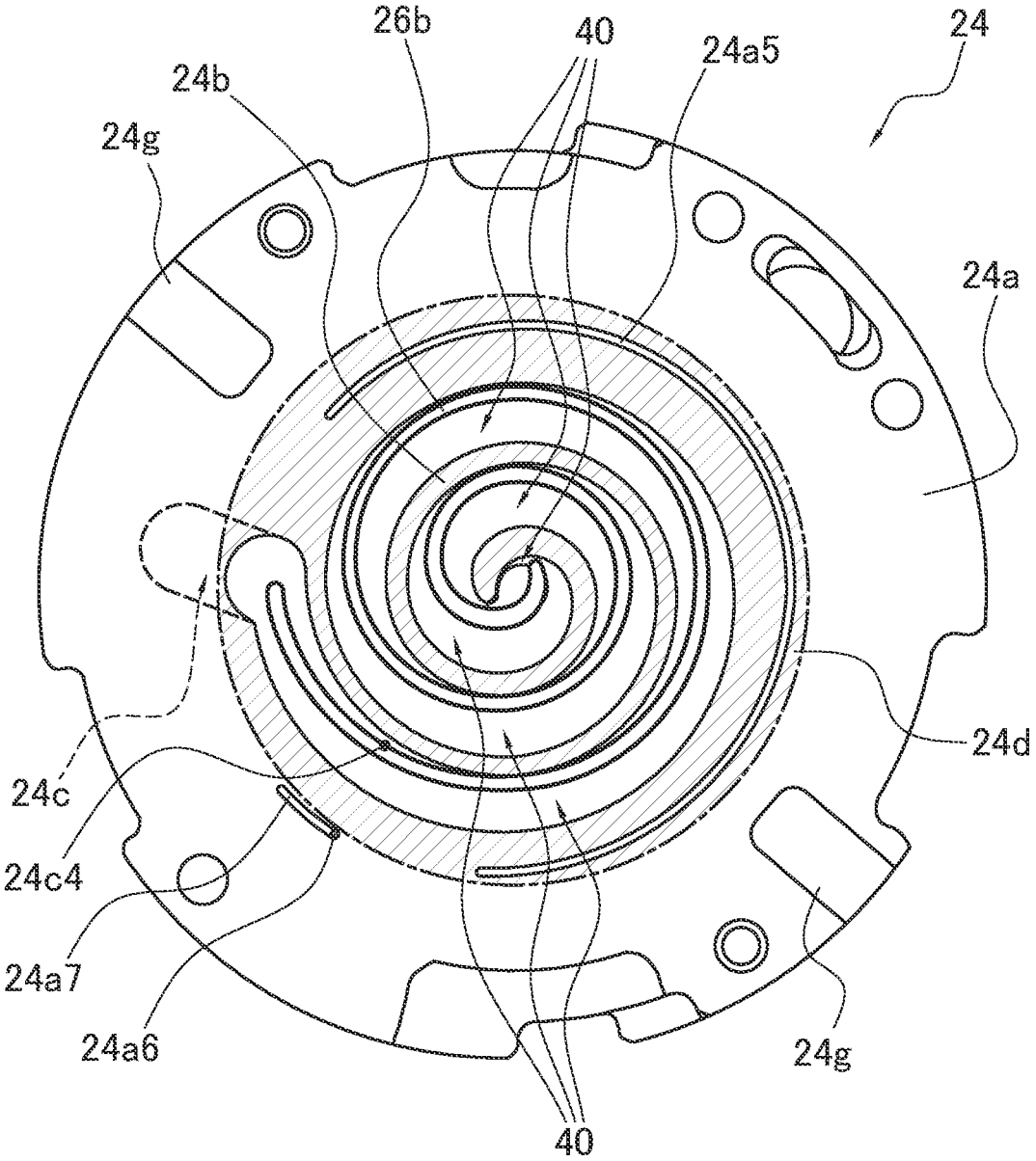
FIG. 4 is a top view of the fixed scroll 24, illustrating a movable-side wrap 26*b* of the movable scroll 26 and a compression chamber 40.

FIG. 4 is a top view of the fixed scroll 24, illustrating the movable-side wrap 26*b*, the movable-side groove 26*a*2, and the compression chamber 40. In FIG. 4, a hatched area represents the thrust sliding surface 24*d*. As illustrated in FIG. 4, the first fixed-side passage 24*a*5 of the fixed scroll 24 is formed on the second lower surface 24*a*4 of the fixed-side end plate 24*a* so as to be accommodated in the thrust sliding surface 24*d*.

On the second lower surface 24*a*4 of the movable-side end plate 26*a*, two second key grooves 26*d* are formed. Into each of the second key grooves 26*d*, a second key part 39*c* of the Oldham's coupling 39 described later is fitted.

(1-3) Housing 23

The housing 23 is disposed below the compression mechanism 15 and above the motor 16. An outer peripheral surface of the housing 23 is airtightly joined to an inner peripheral surface of the body casing part 11. This causes the internal space of the casing 10 to be partitioned into a high-pressure space 71 below the housing 23, a low-pressure space 73 above the housing 23 and above the fixed scroll 24, and a back-pressure space 72. As illustrated in FIG. 1, the back-pressure space 72 is a space surrounded by the housing 23, the fixed scroll 24, and the movable scroll 26. Pressure in the back-pressure space 72 presses the movable scroll 26 against the fixed scroll 24. The oil reservoir 10*a* is located at a bottom part of the high-pressure space 71.

The fixed scroll 24 is placed on the housing 23, and the housing 23 sandwiches the movable scroll 26 together with the fixed scroll 24. In an outer peripheral part of the housing 23, a second compressed refrigerant flow path (not illustrated) is formed. The second compressed refrigerant flow path is a hole penetrating the outer peripheral part of the housing 23 in the vertical direction. The second compressed refrigerant flow path communicates with the first compressed refrigerant flow path on an upper surface of the housing 23, and communicates with the high-pressure space 71 on a lower surface of the housing 23. In other words, the discharge hole 41 of the compression mechanism 15 communicates with the high-pressure space 71 via the enlarged concave portion 42, the first compressed refrigerant flow path, and the second compressed refrigerant flow path.

On the upper surface of the housing 23, a concave portion called a crank chamber 23*a* is formed. In the housing 23, a housing through hole 31 is formed. The housing through hole 31 is a hole penetrating the housing 23 in the vertical direction from a central portion of a bottom surface of the crank chamber 23*a* to a central portion of the lower surface of the housing 23. Hereinafter, a part of the housing 23 and around the housing through hole 31 is referred to as an upper bearing 32. On an outer peripheral part of the bottom surface of the crank chamber 23*a*, an annular groove 23*g* is formed.

The housing 23 is formed with an oil discharge passage 23*b* that allows communication between the crank chamber 23*a* and the high-pressure space 71. In the crank chamber 23*a*, an opening of the oil discharge passage 23*b* is formed near the bottom surface of the crank chamber 23*a*.

In the housing 23, a housing oil supply passage 23*c* for supply of lubricating oil to the compression mechanism 15 is formed. One end of the housing oil supply passage 23*c* is open to the annular groove 23*g*. Another end of the housing oil supply passage 23*c* is open to an outer peripheral part of the upper surface of the housing 23 and communicates with the oil communication passage 24*f* of the fixed scroll 24.

Lubricating oil in the crank chamber 23*a* flows into the first fixed-side passage 24*a*5 via the annular groove 23*g*, the housing oil supply passage 23*c*, and the oil communication passage 24*f*, and is supplied to the compression chamber 40 via the thrust sliding surface 24*d*. Into the housing oil supply passage 23*c*, a throttle mechanism (not illustrated) for decompressing the lubricating oil flowing through the housing oil supply passage 23*c* is inserted.

(1-4) Oldham's Coupling 39

Figure 5:
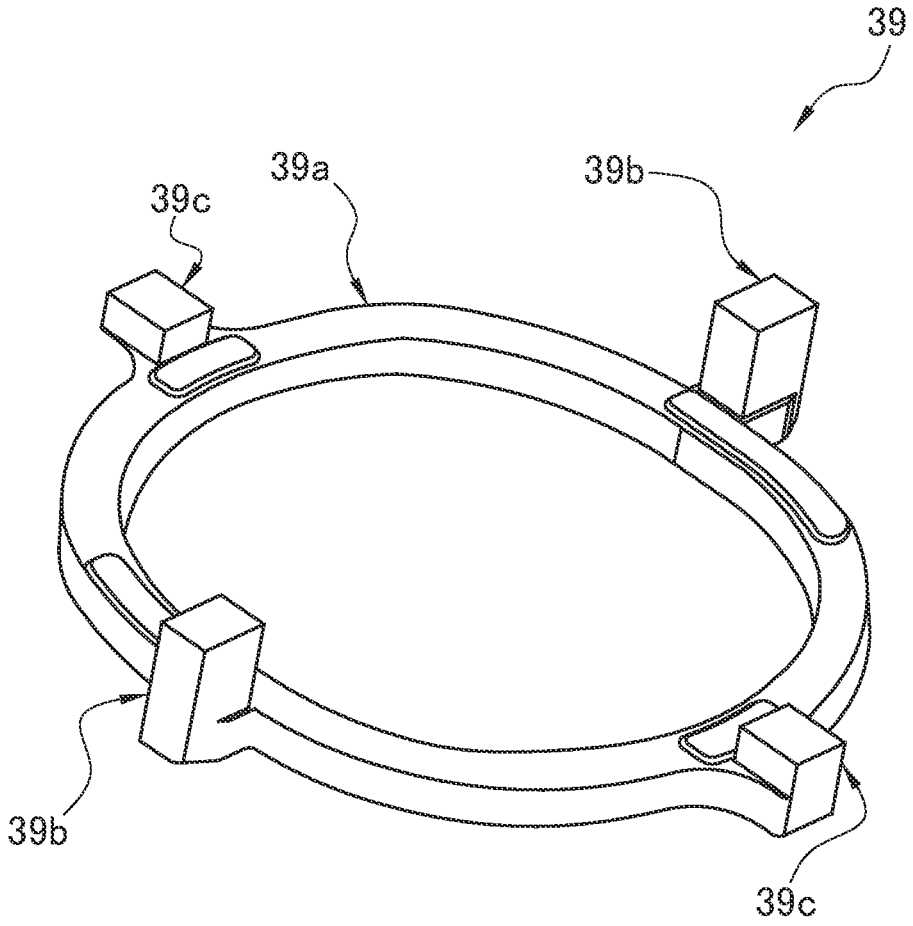
FIG. 5 is a perspective view of an Oldham's coupling 39.

The Oldham's coupling 39 is a member to suppress rotation of the turning movable scroll 26. The Oldham's coupling 39 is disposed between the movable scroll 26 and the housing 23 in the back-pressure space 72. FIG. 5 is a perspective view of the Oldham's coupling 39.

The Oldham's coupling 39 includes an annular main body 39*a*, a pair of the first key parts 39*b*, and a pair of the second key parts 39*c*. The first key part 39*b* and the second key part 39*c* are portions protruding from an upper surface of the annular main body 39*a*. The first key part 39*b* is fitted into the first key groove 24*g* of the fixed scroll 24. The second key part 39*c* is fitted into the second key groove 26*d* of the movable scroll 26. While the movable scroll 26 is turning, the first key part 39*b* reciprocates in the first key groove 24*g* along a predetermined direction, and the second key part 39*c* reciprocates in the second key groove 26*d* along a predetermined direction. This suppresses rotation of the turning movable scroll 26.

(1-5) Motor 16

The motor 16 is disposed below the housing 23. The motor 16 mainly includes a stator 51 and a rotor 52.

The stator 51 mainly includes a stator core 51*a* and a plurality of coils 51*b*. The stator core 51*a* is a member having a cylindrical shape and fixed to an inner peripheral surface of the casing 10. The stator core 51*a* includes a plurality of teeth (not illustrated). The coil 51*b* is formed by winding a winding wire around the teeth.

On an outer peripheral surface of the stator core 51*a*, a plurality of core cuts are formed. The core cut is a groove formed in the vertical direction from an upper end surface to a lower end surface of the stator core 51*a*.

The rotor 52 is a member having a columnar shape and disposed inside the stator core 51*a*. Between an inner peripheral surface of the stator core 51*a* and an outer peripheral surface of the rotor 52, an air gap is formed. The rotor 52 is coupled to the crankshaft 17. The rotor 52 is connected to the compression mechanism 15 via the crankshaft 17. The rotor 52 rotates the crankshaft 17 around a shaft 16*a*. The shaft 16*a* passes through a center axis of the rotor 52.

The motor 16 turns the movable scroll 26 via rotation of the crankshaft 17, to function as a power source for compressing a gas refrigerant in the compression chamber 40.

(1-6) Lower Bearing 60

The lower bearing 60 is disposed below the motor 16. An outer peripheral surface of the lower hearing 60 is joined to the inner peripheral surface of the casing 10. The lower bearing 60 rotatably supports the crankshaft 17.

(1-7) Crankshaft 17

The crankshaft 17 is disposed with an axial direction being along the vertical direction. A shaft center of an upper end part of the crankshaft 17 is eccentric with respect to a shaft center of a portion excluding the upper end part. The crankshaft 17 has a balance weight 18. The balance weight 18 is fixed in close contact with the crankshaft 17 at a height position below the housing 23 and above the motor 16.

The crankshaft 17 passes through a rotation center of the rotor 52 in the vertical direction and is connected to the rotor 52. The upper end part of the crankshaft 17 is fitted into the upper end bearing 26*c* of the movable scroll 26. This connects the crankshaft 17 to the movable scroll 26, to allow rotation of the crankshaft 17 to be transmitted to the movable scroll 26. The crankshaft 17 is rotatably supported by the upper bearing 32 and the lower bearing 60.

Inside the crankshaft 17, a main oil supply passage 61 is formed. The main oil supply passage 61 extends along an axial direction (the vertical direction) of the crankshaft 17. An upper end of the main oil supply passage 61 communicates with an oil chamber 83, which is a space between an upper end surface of the crankshaft 17 and the lower surface of the movable-side end plate 26*a*. A lower end of the main oil supply passage 61 communicates with the oil reservoir 10*a*.

The crankshaft 17 includes a first sub oil supply passage 61*a*, a second sub oil supply passage 61*b*, and a third sub oil supply passage 61*c* that branch from the main oil supply passage 61. The first sub oil supply passage 61*a*, the second sub oil supply passage 61*b*, and the third sub oil supply passage 61*c* extend in a horizontal direction. The first sub oil supply passage 61*a* opens to a sliding part between the crankshaft 17 and the upper end bearing 26*c* of the movable scroll 26. The second sub oil supply passage 61*h* is open to a sliding part between the crankshaft 17 and the upper bearing 32 of the housing 23. The third sub oil supply passage 61*c* is open to a sliding part between the crankshaft 17 and the lower bearing 60.

(1-8) Suction Pipe 19

The suction pipe 19 is a pipe for introducing a refrigerant of the refrigerant circuit from outside the casing 10 to the compression mechanism 15. The suction pipe 19 penetrates the upper wall part 12 of the casing 10. Inside the casing 10, an end part of the suction pipe 19 is fitted into the main suction hole 24*c* of the fixed scroll 24.

(1-9) Discharge Pipe 20

The discharge pipe 20 is a pipe for discharging a compressed refrigerant from the high-pressure space 71 to outside the casing 10. The discharge pipe 20 penetrates the body casing part 11 of the casing 10, (2) Operation of Scroll Compressor 101

First, a flow of a refrigerant inside the scroll compressor 101 will be described. Next, a flow of lubricating oil inside the scroll compressor 101 will be described.

(2-1) Flow of Refrigerant

The low-temperature and low-pressure refrigerant before being compressed is supplied from the suction pipe 19 to the compression chamber 40 of the compression mechanism 15 via the main suction hole 24*c*. In the compression chamber 40, the refrigerant is compressed into a compressed refrigerant. The compressed refrigerant is discharged from the discharge hole 41 to the enlarged concave portion 42, then supplied to the high-pressure space 71, and discharged to outside the scroll compressor 101 from the discharge pipe 20.

(2-2) Flow of Lubricating Oil

When the compression mechanism 15 compresses the refrigerant, and the compressed refrigerant is supplied to the high-pressure space 71, pressure in the high-pressure space 71 increases. The high-pressure space 71 communicates with the first fixed-side passage 24*a*5 of the fixed scroll 24 via the main oil supply passage 61, the crank chamber 23*a*, the annular groove 23*g*, the housing oil supply passage 23*c*, the oil communication passage 24*f*, and the like, and the first fixed-side passage 24*a*5 communicates with the back-pressure space 72 via the thrust sliding surface 24*d*. The back-pressure space 72 is a space having a lower pressure than the high-pressure space 71. Therefore, differential pressure is generated between the high-pressure space 71 and the back-pressure space 72. This differential pressure causes lubricating oil stored in the oil reservoir 10*a* of the high-pressure space 71 to rise in the main oil supply passage 61, to be suctioned toward the back-pressure space 72.

The lubricating oil rising in the main oil supply passage 61 is supplied to individual sliding parts. The sliding parts are a sliding part between the crankshaft 17 and the lower bearing 60, a sliding part between the crankshaft 17 and the upper bearing 32, and a sliding part between the crankshaft 17 and the upper end bearing 26*c*. A part of the lubricating oil having lubricated each sliding part flows into the high-pressure space 71 and returns to the oil reservoir 10*a*, and the rest flows into the crank chamber 23*a*. A part of the lubricating oil having flowed into the crank chamber 23*a* flows into the high-pressure space 71 via the oil discharge passage 23*b*, and returns to the oil reservoir 10*a*. Most of the lubricating oil having flowed into the crank chamber 23*a* passes through the annular groove 23*g*, the housing oil supply passage 23*c*, and the oil communication passage 24*f*, and is supplied to the first fixed-side passage 24*a*5. A part of the lubricating oil supplied to the first fixed-side passage 24*a*5 flows into the back-pressure space 72 and the compression chamber 40 while sealing the thrust sliding surface 24*d*. The lubricating oil having flowed into the compression chamber 40 is mixed into the compressed refrigerant in a state of fine oil droplets, flows into the high-pressure space 71 together with the compressed refrigerant, and returns to the oil reservoir 10*a*.

A part of the lubricating oil supplied to the first fixed-side passage 24*a*5 further passes through the movable-side groove 26*a*2 and the second fixed-side passage 24*a*6 sequentially, and flows into the compression chamber 40. Next, a flow of this lubricating oil will be described.

(3) Detailed Configuration

The first fixed-side passage 24*a*5, the second fixed-side passage 24*a*6, the fixed-side groove 24*a*7, and the movable-side groove 26*a*2 are passages for supply of lubricating oil from the high-pressure space 71 to the compression chamber 40 by differential pressure while the movable scroll 26 turns relative to the fixed scroll 24. The first fixed-side passage 24*a*5 and the fixed-side groove 24*a*7 are formed on the movable-side end plate 26*a* side, on the second lower surface 24*a*4 of the fixed-side end plate 24*a*. The movable-side groove 26*a*2 is formed on the fixed-side end plate 24*a* side, on the first upper surface 26*a*1 of the movable-side end plate 26*a*.

The fixed-side groove 24*a*7 is a substantially arc-shaped groove communicating with the second fixed-side passage 24*a*6. The fixed-side groove 24*a*7 generally extends along a circumferential direction of the fixed-side end plate 24*a*.

Figure 6:
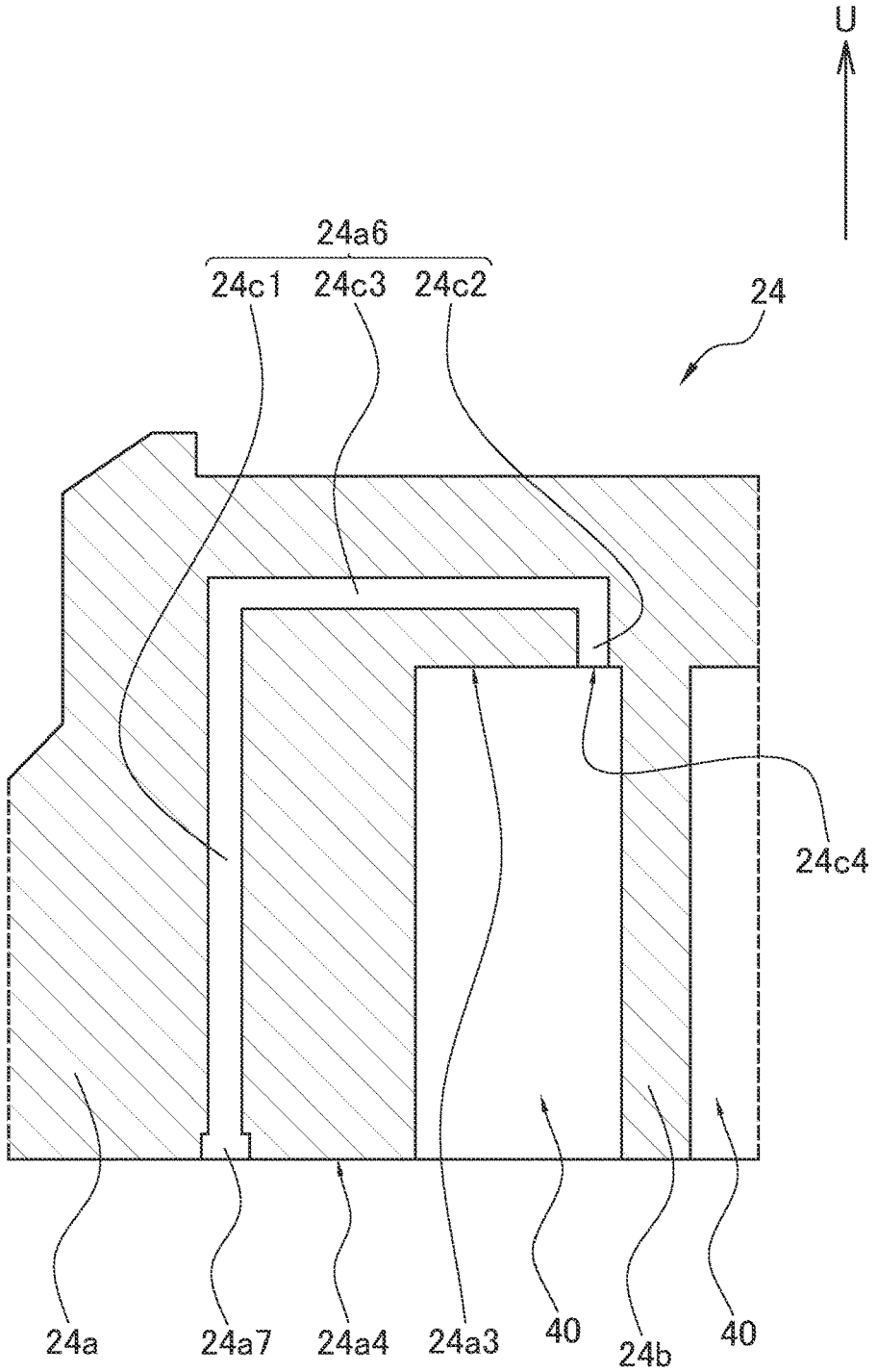
FIG. 6 is a cross-sectional view of the fixed scroll 24 taken along line A-A in 2.

The second fixed-side passage 24*a*6 is a passage for supply of lubricating oil from the high-pressure space 71 to the compression chamber 40. FIG. 6 is a cross-sectional view of the fixed scroll 24 taken along line A-A in FIG. 2. As illustrated in FIG. 6, the second fixed-side passage 24*a*6 includes a first fixed-side hole 24*c*1, a second fixed-side hole 24*c*2, and a third fixed-side hole 24*c*3. The first fixed-side hole 24*c*1 and the second fixed-side hole 24*c*2 extend along the vertical direction. The third fixed-side hole 24*c*3 extends along the horizontal direction. The first fixed-side hole 24*c*1 and the second fixed-side hole 24*c*2 communicate with each other via the third fixed-side hole 24*c*3. The first fixed-side hole 24*c*1 communicates with the fixed-side groove 24*a*7. The second fixed-side hole 24*c*2 communicates with the compression chamber 40 via a fixed-side opening 24*c*4 formed on the first lower surface 24*a*3. The fixed-side opening 24*c*4 is formed on a surface that slides on a distal end surface of the movable-side wrap 26*b*, on the first lower surface 24*a*3. The fixed-side opening 24*c*4 has a diameter smaller than a thickness of the movable-side wrap 26*b*.

A portion other than both end parts of the movable-side groove 26*a*2 generally extends along a circumferential direction of the movable-side end plate 26*a*. The both end parts of the movable-side groove 26*a*2 extend along a radial direction of the movable-side end plate 26*a*. As illustrated in FIG. 4, when the compression mechanism 15 is viewed along the vertical direction, the movable-side groove 26*a*2 is located between the first fixed-side passage 24*a*5 and the fixed-side groove 24*a*7.

The movable-side groove 26*a*2 intermittently allows communication between the first fixed-side passage 24*a*5 and the second fixed-side passage 24*a*6 while the movable scroll 26 turns relative to the fixed scroll 24. While the movable scroll 26 turns relative to the fixed scroll 24, the movable-side groove 26*a*2 always communicates with the first fixed-side passage 24*a*5 and intermittently communicates with the second fixed-side passage 24*a*6.

The high-pressure space 71 communicates with the compression chamber 40 via the first fixed-side passage 24*a*5, the movable-side groove 26*a*2, the fixed-side groove 24*a*7, and the second fixed-side passage 24*a*6 while the movable scroll 26 turns relative to the fixed scroll 24. Specifically, in a process in which the movable scroll 26 turns once relative to the fixed scroll 24, the first fixed-side hole 24*c*1 of the second fixed-side passage 24*a*6 intermittently communicates with the movable-side groove 26*a*2 via the fixed-side groove 24*a*7, and the second fixed-side hole 24*c*2 of the second fixed-side passage 24*a*6 intermittently communicates with the compression chamber 40 via the fixed-side opening 24*c*4. Since the movable-side groove 26*a*2 always communicates with the high-pressure space 71 via the first fixed-side passage 24*a*5, the high-pressure space 71 intermittently communicates with the compression chamber 40 while the movable scroll 26 turns relative to the fixed scroll 24.

Next, with reference to FIGS. 7A to 7D and FIG. 8, a description is given to a change in a communication state of the first fixed-side passage 24*a*5, the movable-side groove 26*a*2, the fixed-side groove 24*a*7, and the second fixed-side passage 24*a*6 (hereinafter, simply referred to as a "communication state") while the movable scroll 26 turns once relative to the fixed scroll 24. Similarly to FIG. 4, FIGS. 7A to 7D are top views of the fixed scroll 24, illustrating the movable-side wrap 26*h*, the movable-side groove 26*a*2, and the compression chamber 40. FIG. 8 is a diagram illustrating a change in the communication state while the movable scroll 26 turns once relative to the fixed scroll 24. In FIG. 8, as the movable scroll 26 turns, the communication state changes counterclockwise.

As illustrated in FIGS. 7A to 7D, the compression chamber 40 includes a first compression chamber 40*a* and a second compression chamber 40*b*. The first compression chamber 40*a* is located on an outermost side in a radial direction of the fixed-side end plate 24*a*. The second compression chamber 40*b* is located inside the first compression chamber 40*a* in the radial direction of the fixed-side end plate 24*a*, and is located between an outermost side surface of the fixed-side wrap 24*b* and an inner side surface of the movable-side wrap 26*b*. The second compression chamber 40*b* is the compression chamber 40 with which the second fixed-side hole 24*c*2 of the second fixed-side passage 24*a*6 intermittently communicates.

Figure 7A:
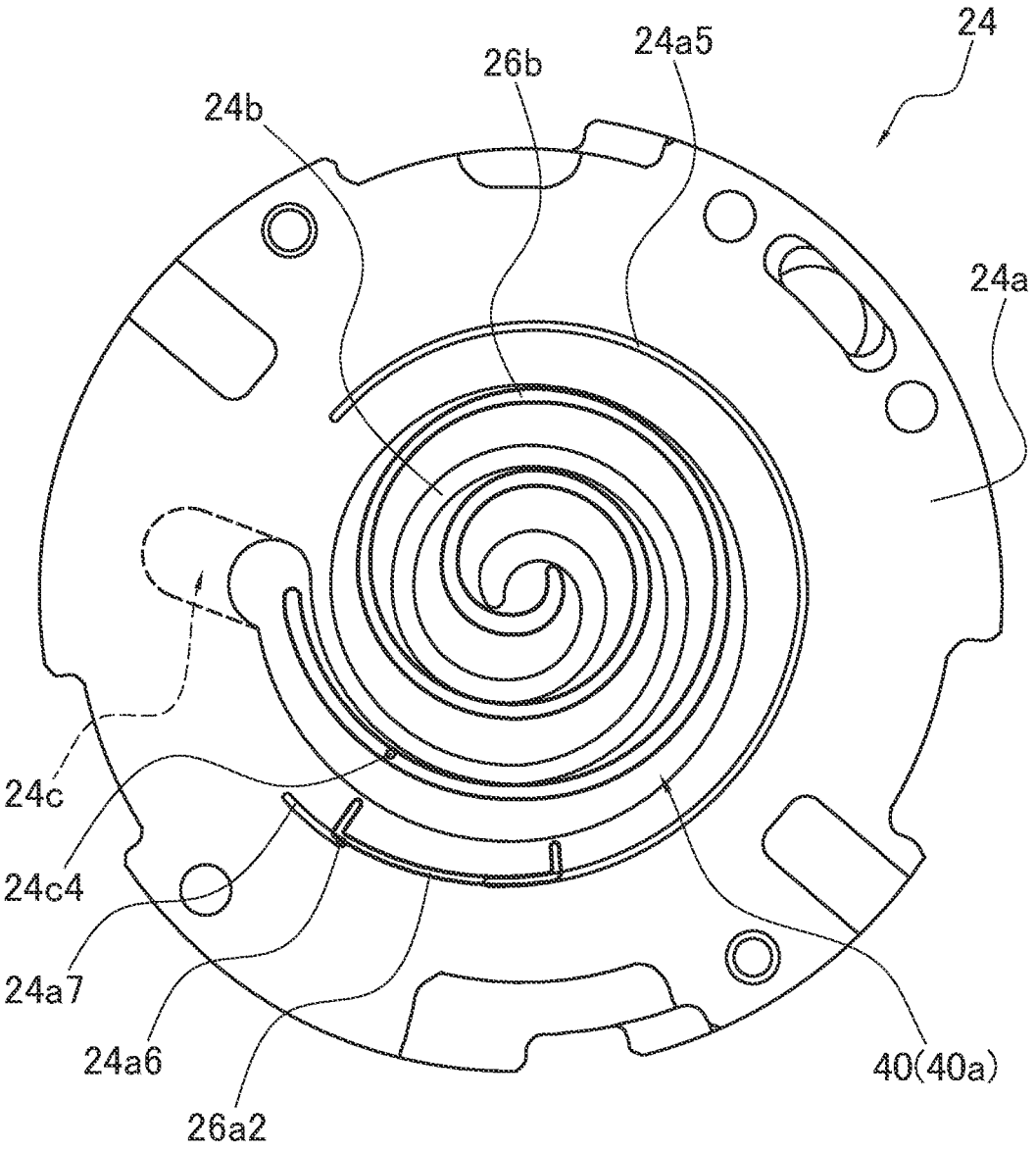
FIG. 7A is a view illustrating a communication state in a first state.

While the movable scroll 26 turns once relative to the fixed scroll 24, the communication state changes sequentially from FIG. 7A to FIG. 7D and returns to FIG. 7A. Hereinafter, the communication states illustrated in FIGS. 7A to 7D are referred to as a first state to a fourth state, respectively.

FIG. 8 illustrates timings of a first period M1 to a fourth period M4 satisfying a predetermined communication state and the first state to the fourth state illustrated in FIGS. 7A to 7D while the movable scroll 26 turns once relative to the fixed scroll 24. While the movable scroll 26 is turning, transition is made in the order of the second period M2, the third period M3, and the fourth period M4, and these periods do not overlap each other.

The first fixed-side passage 24*a*5, the second fixed-side passage 24*a*6, the fixed-side groove 24*a*7, and the movable-side groove 26*a*2 are provided at such positions where transition is repeatedly made in order from the first state to the fourth state while the movable scroll 26 turns once relative to the fixed scroll 24.

In the first state to the fourth state, pressure in the high-pressure space 71 communicating with the first fixed-side passage 24*a*5 is always higher than pressure in the second compression chamber 40*b* intermittently communicating with the second fixed-side hole 24*c*2.

In the first state to the fourth state, pressure in the first fixed-side passage 24*a*5 is always the same as the pressure in the high-pressure space 71. In the process where transition is repeatedly made from the first state to the fourth state, pressure in the second fixed-side passage 24*a*6 (the fixed-side groove 24*a*7) and the movable-side groove 26*a*2 changes.

Hereinafter, a magnitude relationship of the pressure in the first fixed-side passage 24*a*5, the second fixed-side passage 24*a*6 (the fixed-side groove 24*a*7), and the movable-side groove 26*a*2 in the first state to the fourth state respectively corresponding to FIGS. 7A to 7D will be described using the following reference signs.

PF1: pressure in the first fixed-side passage 24*a*5 (pressure in the high-pressure space 71)

PF2: pressure in the second fixed-side passage 24*a*6 (pressure in the fixed-side groove 24*a*7)

PO1: pressure in the movable-side groove 26*a*2

PC2: pressure in the second compression chamber 40*b*

(3-1) First State (Communication State in FIG. 7A)

The first state is a state in the first period M1. In the first state, the movable-side groove 26*a*2 communicates with the first fixed-side passage 24*a*5 and the second fixed-side passage 24*a*6 (the fixed-side groove 24*a*7). In the first state, the fixed-side opening 24*c*4 is closed by the movable-side wrap 26*b*, and the second fixed-side passage 24*a*6 does not communicate with the second compression chamber 40*b*.

A magnitude relationship of the pressure in the first state is represented by PC2<PF2=PO1=PF1. In the first state, a part of lubricating oil flowing from the high-pressure space 71 into the first fixed-side passage 24*a*5 by the differential pressure passes through the movable-side groove 26*a*2 and moves to the second fixed-side passage 24*a*6 and the fixed-side groove 24*a*7. In the first state, since the fixed-side opening 24*c*4 is closed by the movable-side wrap 26*b*, the lubricating oil having moved to the second fixed-side passage 24*a*6 is not supplied to the second compression chamber 40*b*. In the first state, the lubricating oil supplied to the second compression chamber 40*b* in the second state is stored in the fixed-side groove 24*a*7.

Figure 7B:
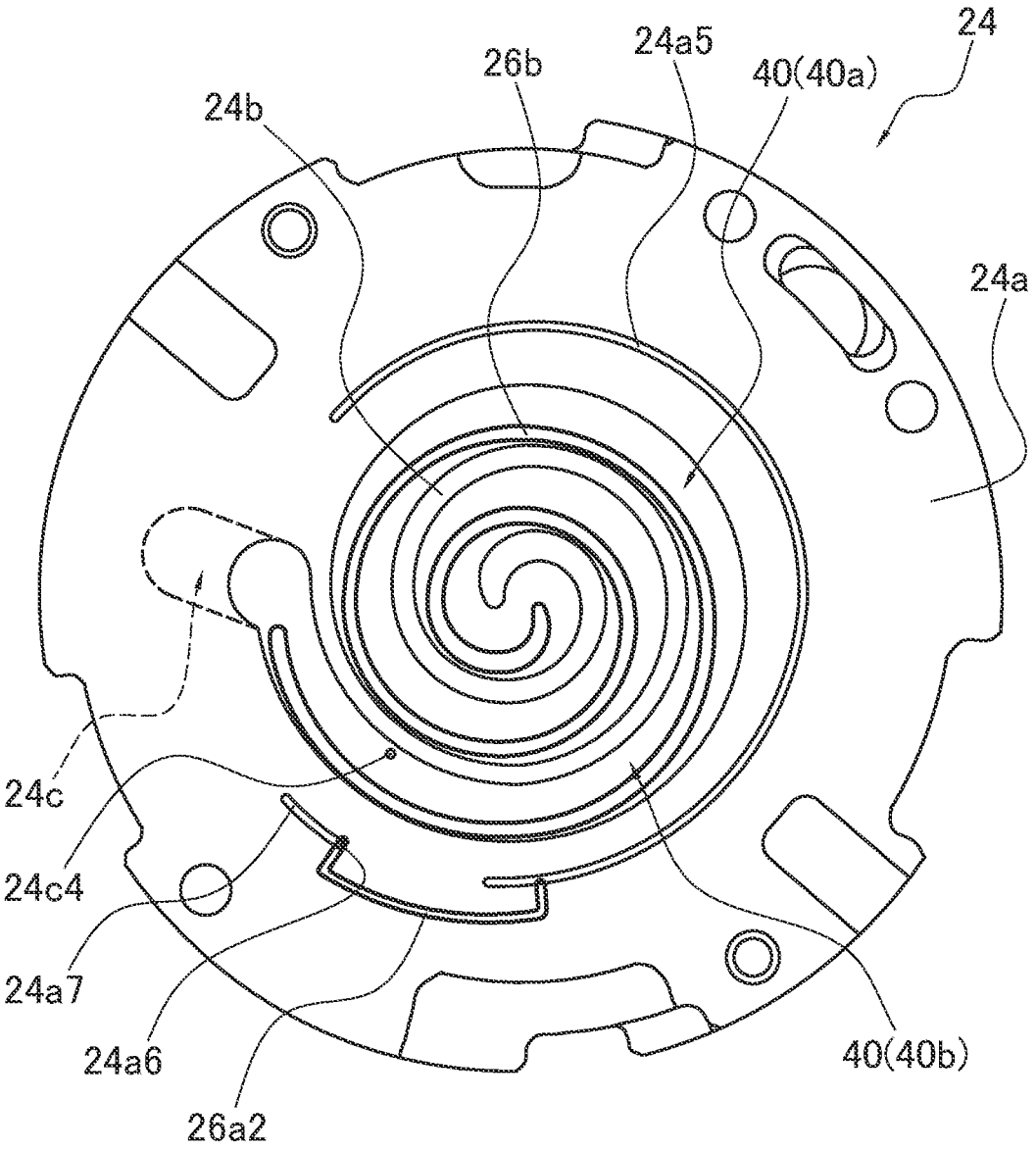
FIG. 7B is a view illustrating a communication state in a second state.
Figure 8:
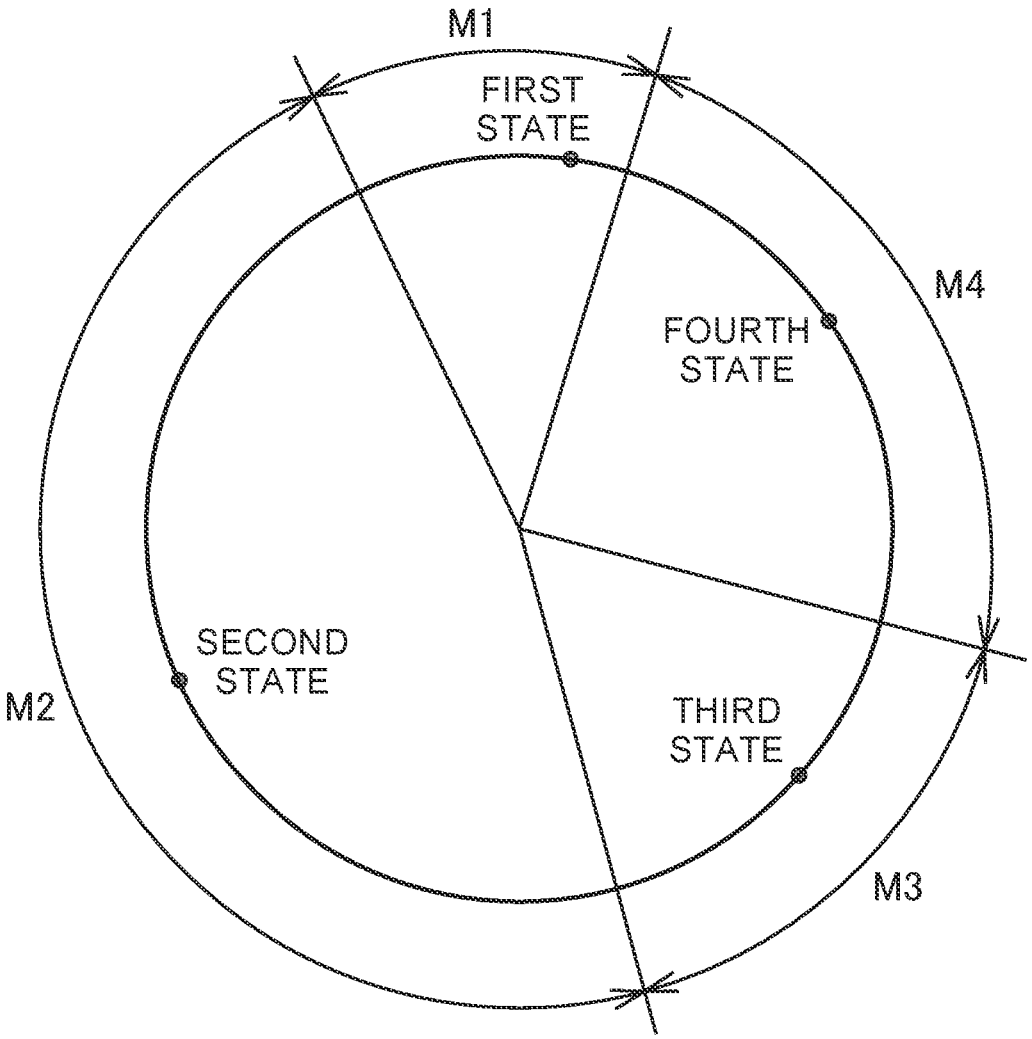
FIG. 8 is a diagram illustrating a change in a communication state while the movable scroll 26 turns once relative to the fixed scroll 24.

(3-2) Second State (Communication State in FIG. 7B)

In a process in which the movable scroll 26 turns to cause transition from the first state to the second state, communication between the second fixed-side passage 24*a*6 and the second compression chamber 40*b* is started.

The second state is a state in the second period M2. In the second state, the movable-side groove 26*a*2 communicates with the first fixed-side passage 24*a*5 and the second fixed-side passage 24*a*6 (the fixed-side groove 24*a*7). In the second state, the fixed-side opening 24*c*4 is not closed by the movable-side wrap 26*b*, and the second fixed-side passage 24*a*6 communicates with the second compression chamber 40*b*.

A magnitude relationship of the pressure in the second state is represented by PC2<PF2=PO1=PF1. In the second state, since PC2<PF2 is satisfied, the lubricating oil in the second fixed-side passage 24*a*6 moves to the second compression chamber 40*b* by the differential pressure. This causes the lubricating oil to be supplied from the high-pressure space 71 to the second compression chamber 40*b* by the differential pressure.

Figure 7C:
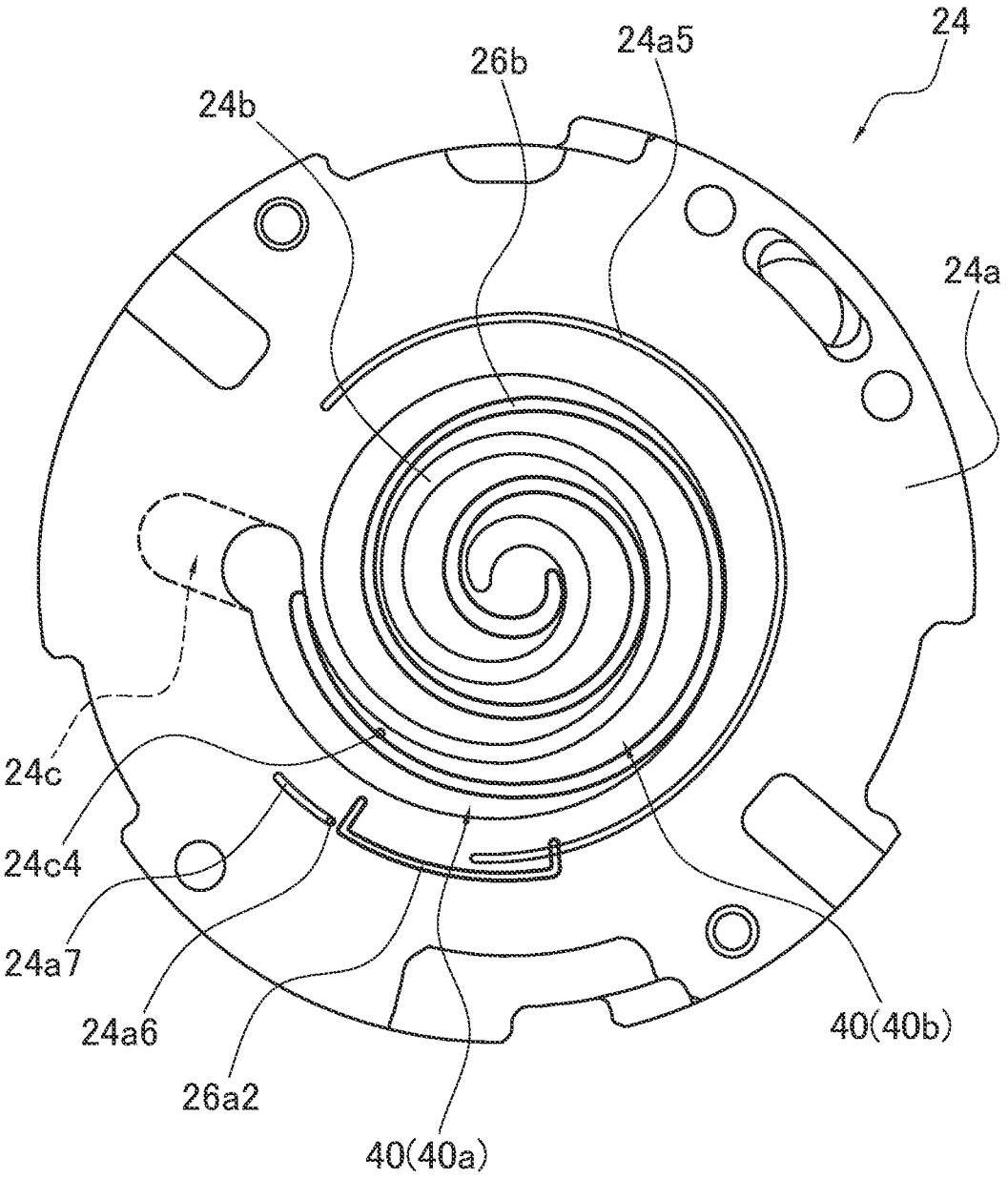
FIG. 7C is a view illustrating a communication state in a third state.

(3-3) Third State (Communication State in FIG. 7C)

In a process in which the movable scroll 26 turns to cause transition from the second state to the third state, the communication between the movable-side groove 26*a*2 and the second fixed-side passage 24*a*6 is ended.

The third state is a state in the third period M3. In the third state, the movable-side groove 26*a*2 communicates with the first fixed-side passage 24*a*5, but does not communicate with the second fixed-side passage 24*a*6 (the fixed-side groove 24*a*7). In the third state, the fixed-side opening 24*c*4 is not closed by the movable-side wrap 26*b*, and the second fixed-side passage 24*a*6 communicates with the second compression chamber 40*b*.

A magnitude relationship of the pressure in the third state is represented by PC2=PF2<PO1=PF1. In the third state, since PC2=PF2 is satisfied, the lubricating oil in the second fixed-side passage 24*a*6 is not supplied to the second compression chamber 40*b* by the differential pressure.

Figure 7D:
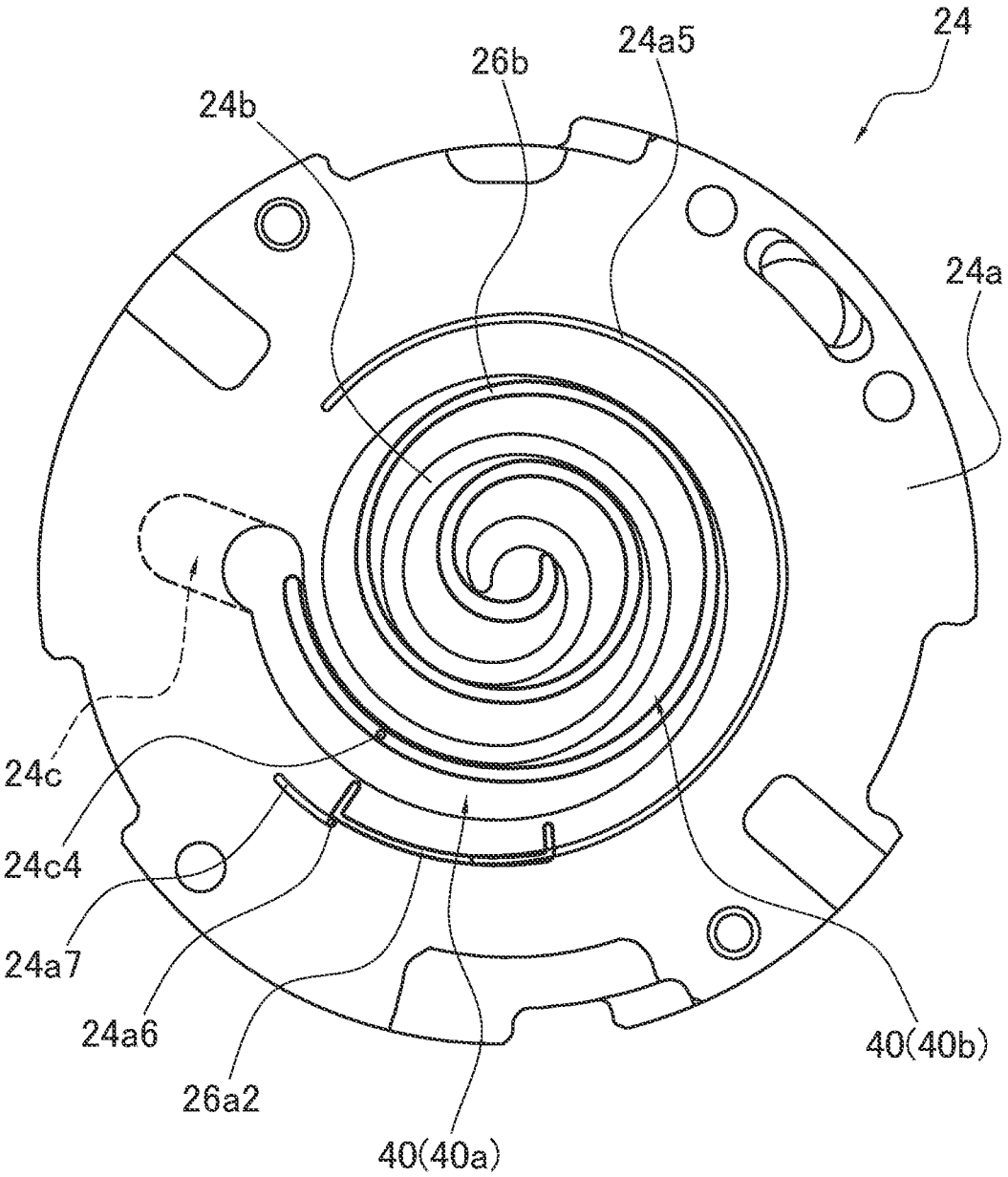
FIG. 7D is a view illustrating a communication state in a fourth state.

(3-4) Fourth State (Communication State in FIG. 7D)

In a process in which the movable scroll 26 turns to cause transition from the third state to the fourth state, the communication between the second fixed-side passage 24*a*6 and the second compression chamber 40*b* is ended.

The fourth state is a state in the fourth period M4. In the fourth state, the movable-side groove 26*a*2 communicates with the first fixed-side passage 24*a*5, but does not communicate with the second fixed-side passage 24*a*6 (the fixed-side groove 24*a*7). In the fourth state, the fixed-side opening 24*c*4 is closed by the movable-side wrap 26*b*, and the second fixed-side passage 24*a*6 does not communicate with the second compression chamber 40*b*.

A magnitude relationship of the pressure in the fourth state is represented by PF2<PC2. In the fourth state, the lubricating oil in the second fixed-side passage 24*a*6 is not supplied to the second compression chamber 40*b*.

(3-5) First State (Communication State in FIG. 7A)

In a process in which the movable scroll 26 turns to cause transition from the fourth state to the first state, the communication between the movable-side groove 26*a*2 and the second fixed-side passage 24*a*6 is started.

(4) Features (4-1)

In the scroll compressor 101, as illustrated in FIGS. 7A to 7D, the high-pressure space 71 communicates with the second compression chamber 40*b* via the first fixed-side passage 24*a*5, the movable-side groove 26*a*2, the fixed-side groove 24*a*7, and the second fixed-side passage 24*a*6 while the movable scroll 26 turns relative to the fixed scroll 24. This causes the lubricating oil in the high-pressure space 71 to be supplied to the second compression chamber 40*b* by the differential pressure while the movable scroll 26 turns relative to the fixed scroll 24.

In a conventional configuration, there is a case where lubricating oil is not sufficiently supplied to the second compression chamber 40*b* located between the outermost side surface of the fixed-side wrap 24*b* and the inner side surface of the movable-side wrap 26*b* and located inside the first compression chamber 40*a* located on the outermost side, and leakage of the refrigerant from the second compression chamber 40*b* cannot be sufficiently suppressed. However, the scroll compressor 101 has a mechanism for supply of lubricating oil from the high-pressure space 71 to the second compression chamber 40*b*, and thus can sufficiently suppress leakage of the refrigerant from the second compression chamber 40*b*. This suppresses deterioration in volumetric efficiency and heat insulating efficiency of the scroll compressor 101.

(4-2)

In the scroll compressor 101, the lubricating oil in the high-pressure space 71 is supplied to the second compression chamber 40*b* by the differential pressure, which eliminates necessity of a power source for supply of the lubricating oil to the second compression chamber (4-3)

In the scroll compressor 101, by changing positions and dimensions of the first fixed-side passage 24*a*5, the movable-side groove 26*a*2, the fixed-side groove 24*a*7, and the second fixed-side passage 24*a*6, it is possible to adjust a time and a timing of communication between the high-pressure space 71 and the second compression chamber 40*b*. Therefore, in the scroll compressor 101, it is possible to relatively easily control the timing of supplying the lubricating oil to the second compression chamber 40*b* and an amount of the lubricating oil supplied to the second compression chamber 40*b*.

For example, by adjusting a length of the fixed-side groove 24*a*7, the amount of lubricating oil supplied to the second compression chamber 40*b* can be controlled. By adjusting a position of the fixed-side opening 24*c*4 of the second fixed-side passage 24*a*6, it is possible to control a period during which the second fixed-side passage 24*a*6 communicates with the second compression chamber 40*b*.

(4-4)

In the scroll compressor 101, the fixed-side opening 24*c*4 has a diameter smaller than a thickness of the movable-side wrap 26*b*. Therefore, while the movable scroll 26 turns relative to the fixed scroll 24, there is a period in which the fixed-side opening 24*c*4 is closed by the movable-side wrap 26*b*, and in this period, the second fixed-side passage 24*a*6 does not communicate with the second compression chamber 40*b*. Therefore, in the scroll compressor 101, the timing of supplying the lubricating oil to the second compression chamber 40*b* can be controlled by appropriately setting the position of the fixed-side opening 24*c*4.

(4-5)

In the scroll compressor 101, the fixed scroll 24 has the first fixed-side passage 24*a*5 to which lubricating oil is supplied. A part of the lubricating oil supplied to the first fixed-side passage 24*a*5 flows into the back-pressure space 72 and the compression chamber 40 while sealing the thrust sliding surface 24*d*. This suppresses seizure of a sliding surface of the fixed scroll 24.

(5) Modifications (5-1) Modification A

In the scroll compressor 101, one end of the second fixed-side passage 24*a*6 communicates with the fixed-side groove 24*a*7. However, if the movable-side groove 26*a*2 intermittently communicates with the second fixed-side passage 24*a*6 while the movable scroll 26 turns relative to the fixed scroll 24, the fixed-side groove 24*a*7 does not need to be formed on the second lower surface 24*a*4 of the fixed-side end plate 24*a*. In this case, the first fixed-side hole 24*c*1 opens to the second lower surface 24*a*4.

(5-2) Modification B

In the scroll compressor 101, the second fixed-side passage 24*a*6 intermittently communicates with the second compression chamber 40*b* while the movable scroll 26 turns relative to the fixed scroll 24. However, the second fixed-side passage 24*a*6 (the second fixed-side hole 24*c*2) may further intermittently communicate with the first compression chamber 40*a*. In this case, the scroll compressor 101 can intermittently supply lubricating oil not only to the second compression chamber 40*b* but also to the first compression chamber 40*a* while the movable scroll 26 turns relative to the fixed scroll 24. This sufficiently suppresses leakage of the refrigerant from the first compression chamber 40*a*.

Conclusion

Although the embodiment of the present disclosure has been described above, it will be understood that various changes in form and details can be made without departing from the spirit and scope of the present disclosure described in claims.

The invention claimed is:

1. A scroll compressor comprising:

a fixed scroll including a fixed-side end plate and a fixed-side wrap; and a movable scroll including a movable-side end plate and a movable-side wrap, the fixed-side end plate including a first fixed-side passage that communicates with a high-pressure space, and a second fixed-side passage configured to supply lubricating oil from the high-pressure space to a compression chamber formed between the fixed scroll and the movable scroll, the movable-side end plate including a movable-side groove that intermittently allows communication between the first fixed-side passage and the second fixed-side passage while the movable scroll revolves relative to the fixed scroll, the compression chamber including a first compression chamber located on an outermost side, and a second compression chamber located inside the first compression chamber and located between an outermost side surface of the fixed-side wrap and an inner side surface of the movable-side wrap, and the second fixed-side passage including a first fixed-side hole that intermittently communicates with the movable-side groove while the movable scroll revolves relative to the fixed scroll, and a second fixed-side hole that communicates with the first fixed-side hole and intermittently communicates with the second compression chamber while the movable scroll revolves relative to the fixed scroll.

2. The scroll compressor according to claim 1, wherein the second fixed-side hole has a fixed-side opening that is open to a surface of the fixed-side end plate, the surface sliding on the movable-side wrap.

3. The scroll compressor according to claim 2, wherein the fixed-side opening has a diameter smaller than a thickness of the movable-side wrap.

4. The scroll compressor according to claim 2, wherein the fixed-side end plate further includes a fixed-side groove that communicates with the second fixed-side passage, and the fixed-side groove intermittently communicates with the movable-side groove while the movable scroll revolves relative to the fixed scroll.

5. The scroll compressor according to claim 2, wherein the second fixed-side hole further intermittently communicates with the first compression chamber while the movable scroll revolves relative to the fixed scroll.

6. The scroll compressor according to claim 2, wherein the first fixed-side passage, the movable-side groove, and the second fixed-side passage are configured to supply lubricating oil from the high-pressure space to the compression chamber by differential pressure while the movable scroll revolves relative to the fixed scroll.

7. The scroll compressor according to claim 2, wherein the first fixed-side passage, the second fixed-side passage, and the movable-side groove are provided at positions such that transition is sequentially and repeatedly made from a first state to a fourth state while the movable scroll revolves relative to the fixed scroll, in the first state, the movable-side groove communicates with the first fixed-side passage and the second fixed-side passage, and the second fixed-side passage does not communicate with the second compression chamber, in the second state the movable-side groove communicates with the first fixed-side passage and the second fixed-side passage, and the second fixed-side passage communicates with the second compression chamber, in the third state the movable-side groove communicates with the first fixed-side passage, the movable-side groove does not communicate with the second fixed-side passage, and the second fixed-side passage communicates with the second compression chamber, and in the fourth state the movable-side groove communicates with the first fixed-side passage, the movable-side groove does not communicate with the second fixed-side passage, and the second fixed-side passage does not communicate with the second compression chamber.

8. The scroll compressor according to claim 1, wherein the fixed-side end plate further includes a fixed-side groove that communicates with the second fixed-side passage, and the fixed-side groove intermittently communicates with the movable-side groove while the movable scroll revolves relative to the fixed scroll.

9. The scroll compressor according to claim 8, wherein the second fixed-side hole further intermittently communicates with the first compression chamber while the movable scroll revolves relative to the fixed scroll.

10. The scroll compressor according to claim 8, wherein the first fixed-side passage, the movable-side groove, and the second fixed-side passage are configured to supply lubricating oil from the high-pressure space to the compression chamber by differential pressure while the movable scroll revolves relative to the fixed scroll.

11. The scroll compressor according to claim 8, wherein the first fixed-side passage, the second fixed-side passage, and the movable-side groove are provided at positions such that transition is sequentially and repeatedly made from a first state to a fourth state while the movable scroll revolves relative to the fixed scroll, in the first state, the movable-side groove communicates with the first fixed-side passage and the second fixed-side passage, and the second fixed-side passage does not communicate with the second compression chamber, in the second state the movable-side groove communicates with the first fixed-side passage and the second fixed-side passage, and the second fixed-side passage communicates with the second compression chamber, in the third state the movable-side groove communicates with the first fixed-side passage, the movable-side groove does not communicate with the second fixed-side passage, and the second fixed-side passage communicates with the second compression chamber, and in the fourth state the movable-side groove communicates with the first fixed-side passage, the movable-side groove does not communicate with the second fixed-side passage, and the second fixed-side passage does not communicate with the second compression chamber.

12. The scroll compressor according to claim 1, wherein the second fixed-side hole further intermittently communicates with the first compression chamber while the movable scroll revolves relative to the fixed scroll.

13. The scroll compressor according to claim 12, wherein the first fixed-side passage, the movable-side groove, and the second fixed-side passage are configured to supply lubricating oil from the high-pressure space to the compression chamber by differential pressure while the movable scroll revolves relative to the fixed scroll.

14. The scroll compressor according to claim 12, wherein the first fixed-side passage, the second fixed-side passage, and the movable-side groove are provided at positions such that transition is sequentially and repeatedly made from a first state to a fourth state while the movable scroll revolves relative to the fixed scroll, in the first state, the movable-side groove communicates with the first fixed-side passage and the second fixed-side passage, and the second fixed-side passage does not communicate with the second compression chamber, in the second state the movable-side groove communicates with the first fixed-side passage and the second fixed-side passage, and the second fixed-side passage communicates with the second compression chamber, in the third state the movable-side groove communicates with the first fixed-side passage, the movable-side groove does not communicate with the second fixed-side passage, and the second fixed-side passage communicates with the second compression chamber, and in the fourth state the movable-side groove communicates with the first fixed-side passage, the movable-side groove does not communicate with the second fixed-side passage, and the second fixed-side passage does not communicate with the second compression chamber.

15. The scroll compressor according to claim 1, wherein the first fixed-side passage, the movable-side groove, and the second fixed-side passage are configured to supply lubricating oil from the high-pressure space to the compression chamber by differential pressure while the movable scroll revolves relative to the fixed scroll.

16. The scroll compressor according to claim 15, wherein the first fixed-side passage, the second fixed-side passage, and the movable-side groove are provided at positions such that transition is sequentially and repeatedly made from a first state to a fourth state while the movable scroll revolves relative to the fixed scroll, in the first state, the movable-side groove communicates with the first fixed-side passage and the second fixed-side passage, and the second fixed-side passage does not communicate with the second compression chamber, in the second state the movable-side groove communicates with the first fixed-side passage and the second fixed-side passage, and the second fixed-side passage communicates with the second compression chamber, in the third state the movable-side groove communicates with the first fixed-side passage, the movable-side groove does not communicate with the second fixed-side passage, and the second fixed-side passage communicates with the second compression chamber, and in the fourth state the movable-side groove communicates with the first fixed-side passage, the movable-side groove does not communicate with the second fixed-side passage, and the second fixed-side passage does not communicate with the second compression chamber.

17. The scroll compressor according to claim 1, wherein the first fixed-side passage, the second fixed-side passage, and the movable-side groove are provided at positions such that transition is sequentially and repeatedly made from a first state to a fourth state while the movable scroll revolves relative to the fixed scroll, in the first state, the movable-side groove communicates with the first fixed-side passage and the second fixed-side passage, and the second fixed-side passage does not communicate with the second compression chamber, in the second state the movable-side groove communicates with the first fixed-side passage and the second fixed-side passage, and the second fixed-side passage communicates with the second compression chamber, in the third state the movable-side groove communicates with the first fixed-side passage, the movable-side groove does not communicate with the second fixed-side passage, and the second fixed-side passage communicates with the second compression chamber, and in the fourth state the movable-side groove communicates with the first fixed-side passage, the movable-side groove does not communicate with the second fixed-side passage, and the second fixed-side passage does not communicate with the second compression chamber.

* * * * *